US006328182B1

(12) United States Patent
Brugner

(10) Patent No.: US 6,328,182 B1
(45) Date of Patent: Dec. 11, 2001

(54) TWO-COMPONENT CARTRIDGE

(75) Inventor: Nikolaus Brugner, Ziemetshausen (DE)

(73) Assignee: Sulzer Chemtech AG, Winterthur (CH)

( * ) Notice: Subject to any disclaimer, the term of this patent is extended or adjusted under 35 U.S.C. 154(b) by 0 days.

(21) Appl. No.: 09/621,878

(22) Filed: Jul. 21, 2000

(30) Foreign Application Priority Data

Jul. 23, 1999 (DE) ..... 299 12 890 U

(51) Int. Cl.[7] ..... B67D 5/60
(52) U.S. Cl. ..... 222/145.6; 222/137
(58) Field of Search ..... 222/129, 135, 222/145.1, 145.5, 145.6, 564, 567, 137

(56) References Cited

U.S. PATENT DOCUMENTS

| | | | | |
|---|---|---|---|---|
| Re. 36,235 | * | 6/1999 | Keller et al. | 222/137 |
| 4,771,919 | * | 9/1988 | Ernst | 222/134 |
| 5,080,262 | * | 1/1992 | Herold et al. | 222/135 |
| 5,137,182 | * | 8/1992 | Keller | 222/153 |
| 5,228,599 | * | 7/1993 | Keller | 222/137 |
| 5,443,183 | * | 8/1995 | Jacobsen et al. | 222/145.6 |
| 5,918,772 | * | 7/1999 | Keller et al. | 222/145.6 |
| 5,944,226 | * | 8/1999 | Schiltz et al. | 222/137 |
| 6,065,645 | * | 5/2000 | Sawhney et al. | 222/137 |
| 6,135,631 | * | 10/2000 | Keller | 366/339 |
| 6,186,363 | * | 2/2001 | Keller et al. | 222/145.6 |

* cited by examiner

*Primary Examiner*—Kevin Shaver
*Assistant Examiner*—Frederick C Nicolas
(74) *Attorney, Agent, or Firm*—Flynn, Thiel, Boutell & Tanis, P.C.

(57) ABSTRACT

The fill materials in the chambers of a two-component cartridge separated by the separating wall enter into outlet openings. An insert piece is mounted onto a small tube in which is formed the outlet opening, over which grips a mixing channel. The insert piece and the separating wall (3A) are connected fixed against rotation to one another. The fill material from the outlet opening (8A) passes over into a passage opening (18A) and exits through the outlet (22) from the insert piece (10A). The fill material from the outlet opening (7A) passes over into a passage opening (17A) and moves from there into a channel (23), which has the outlet (21A). The outlets (21A) and (22) are arranged closely adjacent to one another so that a mixing of the two fill materials occurs already during entry into the mixing chamber (14A) of the mixing channel (9A).

11 Claims, 5 Drawing Sheets

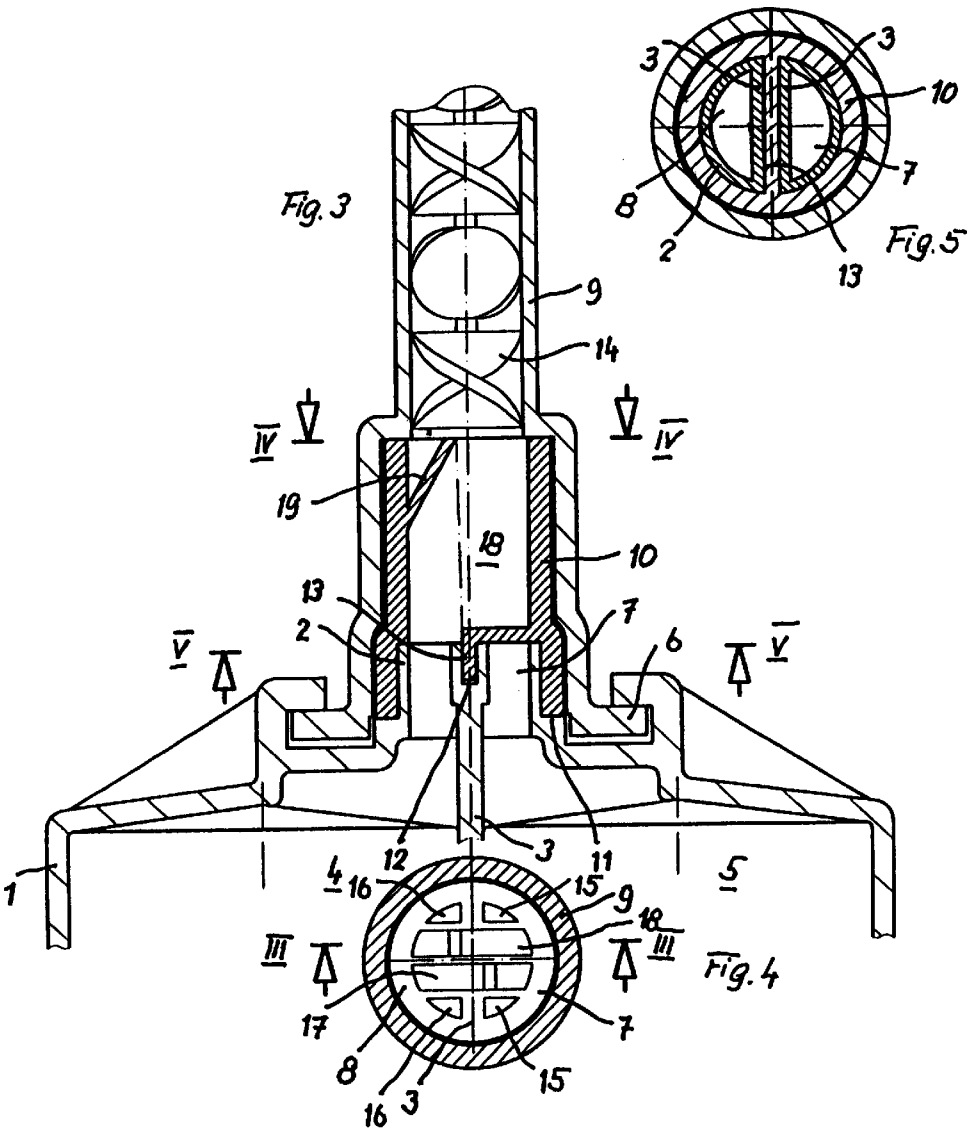
Fig. 5
Fig. 3
Fig. 4
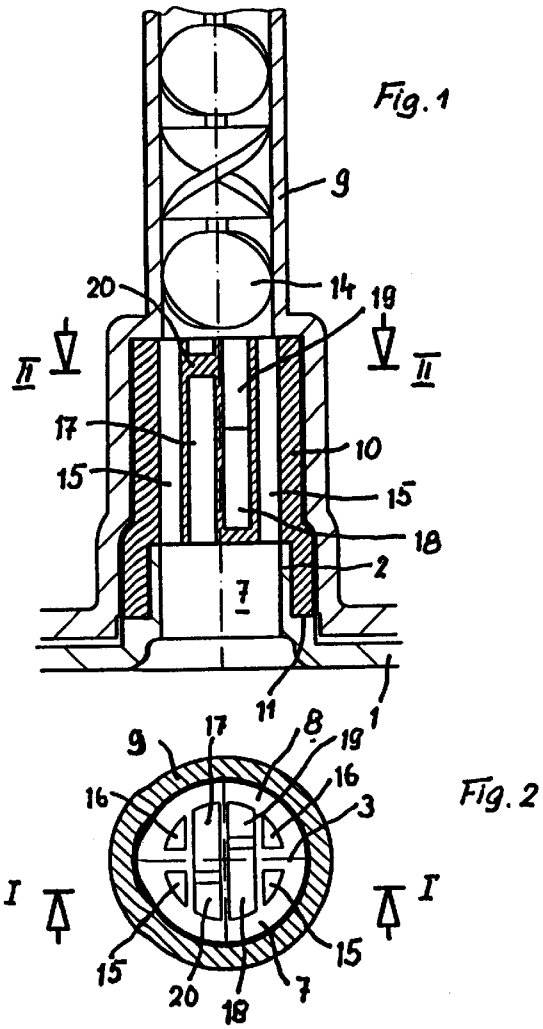
Fig. 1
Fig. 2

TWO-COMPONENT CARTRIDGE

FIELD OF THE INVENTION

The invention relates to a two-component cartridge and a dispensing structure therefor.

BACKGROUND OF THE INVENTION

The components in a two-component cartridge are mixed with one another in a mixing channel mounted on the cartridge. The cartridge and the mixing channel are usually connected to one another through a releasable bayonet lock.

When using these cartridges and mixing channels, the problem arises that during extended interruptions in operation not only the mass in the mixing channels hardens but the hardening continues for some millimeters into the neck of the cartridge so that when a new mixing channel is mounted obstructions occur and hardened material must be removed from the neck area of the cartridge.

In order to solve this problem, it is known to design the cartridge outlet openings in the form of two projecting small tubes. An insert piece sitting in the mixing channel dips into these small tubes so that the hardening occurs in the mixing channel and the mixing-channel insert piece. When removing the mixing channel the insert piece is also removed. A disadvantage of this known design is that the insert piece reduces the outlet cross section and thus considerable pressure must be applied onto the cartridge piston when emptying the cartridge.

It is furthermore disadvantageous that mixer and cartridge do not correspond to the common design and are thus not compatible therewith. The common design has a small tube with a separating wall thus forming two half-moon like outlet openings.

The cartridge outlet openings are in a second design formed by two bores arranged at a distance from one another. The insert piece consists in this case of a soft plastic and sealingly abuts the edge of the bores. Attention must be paid in this design that the channels extending through the insert piece are aligned with the aforementioned bores of the cartridge.

The purpose of the invention is to provide a two-component cartridge in such a manner that a mixing channel of common design can be used with the usual design of the cartridge, in which mixing channel occurs a premixing of the material components of the cartridge at the inlet into the mixing channel.

BRIEF DESCRIPTION OF THE DRAWINGS

Exemplary embodiments will be discussed in greater detail hereinafter in connection with the drawings, in which:

FIG. 1 is a cross-sectional view of a first embodiment taken along the line I—I of FIG. 2;

FIG. 2 is a cross-sectional view taken along the line II—II of FIG. 1;

FIG. 3 is a cross-sectional view of the first embodiment taken along the line III—III of FIG. 4;

FIG. 4 is a cross-sectional view taken along the line IV—IV of FIG. 3;

FIG. 5 is a cross-sectional view taken along the line V—V of FIG. 3;

DETAILED DESCRIPTION

Figure 6:
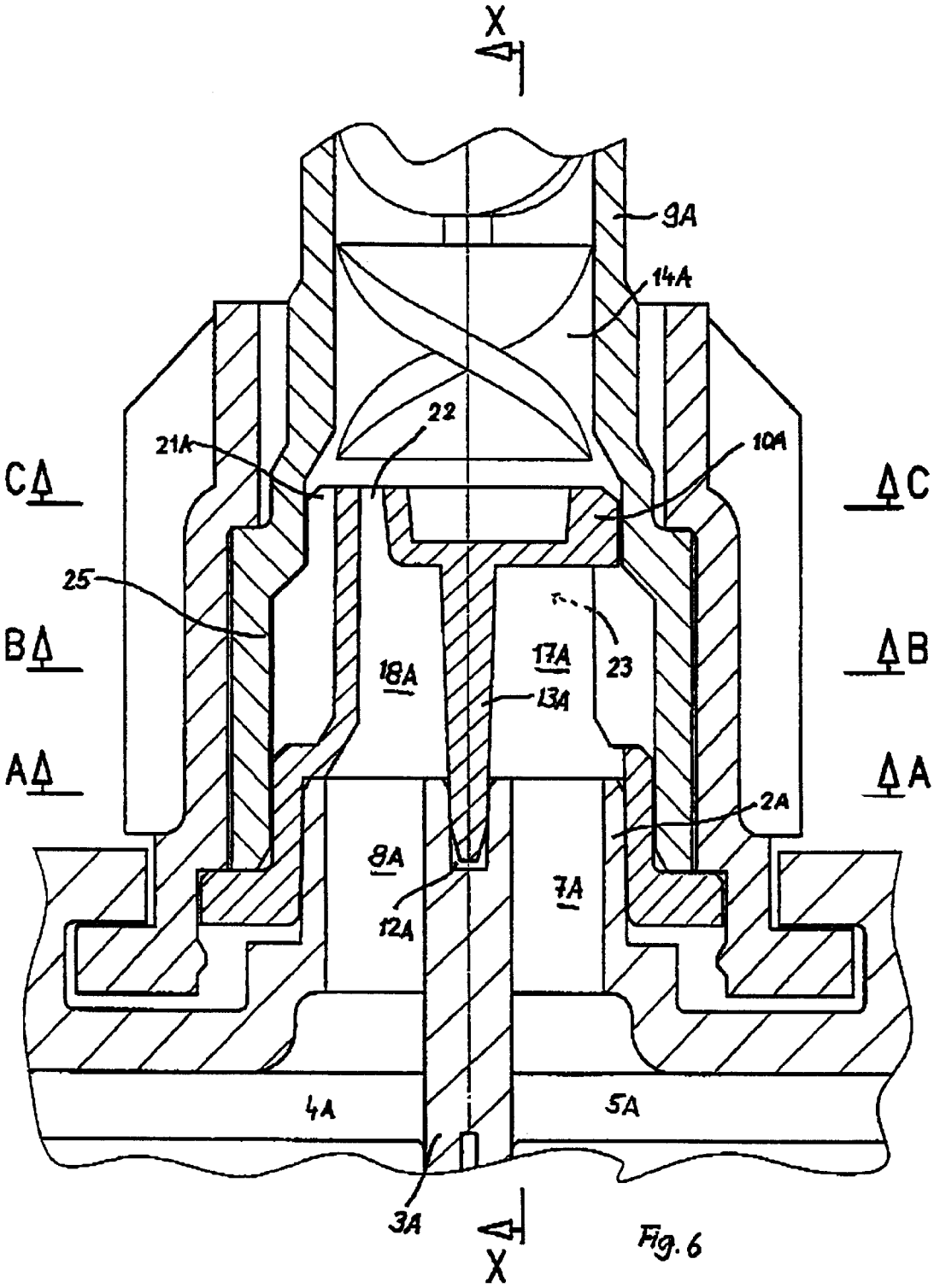
FIG. 6 is a longitudinal cross-sectional view of a second embodiment.
Figure 7:
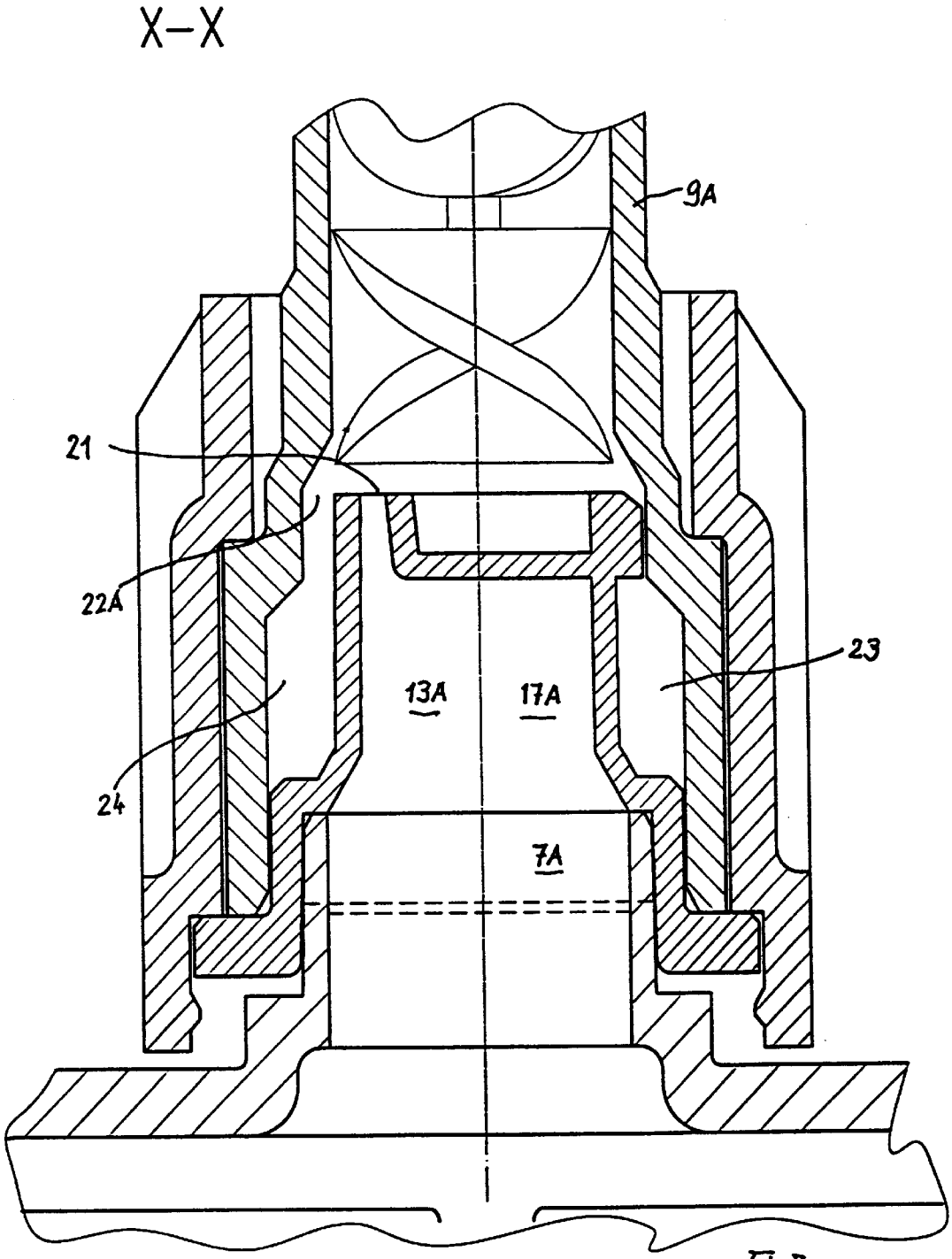
FIG. 7 is a cross-sectional view taken along the line X—X of FIG. 6.
Figure 8:
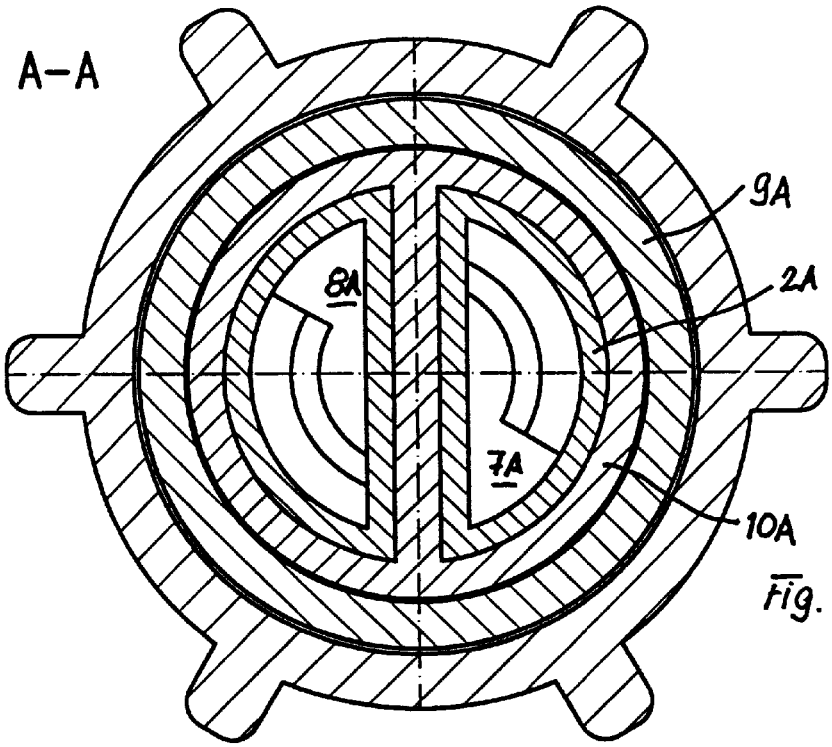
FIG. 8 is a cross-sectional view taken along the line A—A of FIG. 6.

The two-component cartridge 1 has a small tube 2 through which extends a separating wall 3 (FIG. 3) dividing the cartridge into two chambers 4 and 5. The separating wall 3 forms two half-moon like outlet openings 7, 8 in the small tube 2.

A mixing channel 9 is mounted onto the cartridge 1 by means of a bayonet lock 6. The mixing channel 9 grips with its lower part over an insert piece 10. This insert piece 10 telescopically grips with its lower part over the small tube 2 and sits with its lower end on a shoulder 11 surrounding the small tube 2.

The separating wall 3 has a groove 12 in its upper end. The center web 13 (FIGS. 3 and 5) of the insert piece 10 is received in the groove 12. The center web 13 can extend to the upper end of the insert piece 10.

The passage openings have in the illustrated exemplary embodiment a shape which causes the two components of the chambers 4 and 5 to be mixed with one another already during entry into the mixing chamber 14 of the mixing channel 9.

Two laterally spaced passage openings 15 (FIG. 2) extend from the outlet opening 7 of the chamber 5 axially through the insert piece 10 to the upper end of the insert piece 10. Similarly (but not illustrated in FIG. 1), two laterally spaced passage openings 16 extend from the outlet opening 8 of the chamber 4 axially through the insert piece 10 to the upper end of the insert piece 10. Two further passage openings 17, 18 are arranged between the passage openings 15 and the passage openings 16. The lower inlet of the passage opening 17 communicates with the outlet opening 7 of the chamber 5, whereas the inlet of the passage opening 18 communicates with the outlet opening 8 of the chamber 4. The passage openings 17, 18 have each an inclined extending lip 19, 20, the inclinations of which are opposite to one another. This has the result that the outlet of the passage opening 17 lies at the upper end of the insert piece 10 between the two passage openings 16, whereas the outlet of the passage opening 18 lies between the two passage openings 15. Thus, a material stream flows from the chamber 4 to the inlet of the mixing chamber 14 between two material streams from the chamber 5 and a material stream from the chamber 5 between two material streams from the chamber 4. This means that between the two material streams from the passage opening 15, which communicates with the chamber 5, exits a material stream from the passage opening 18, which communicates with the chamber 4. The same is true regarding the passage openings 16 communicating with the chamber 4 and the passage opening 17 communicating with the chamber 5.

Figure 9:
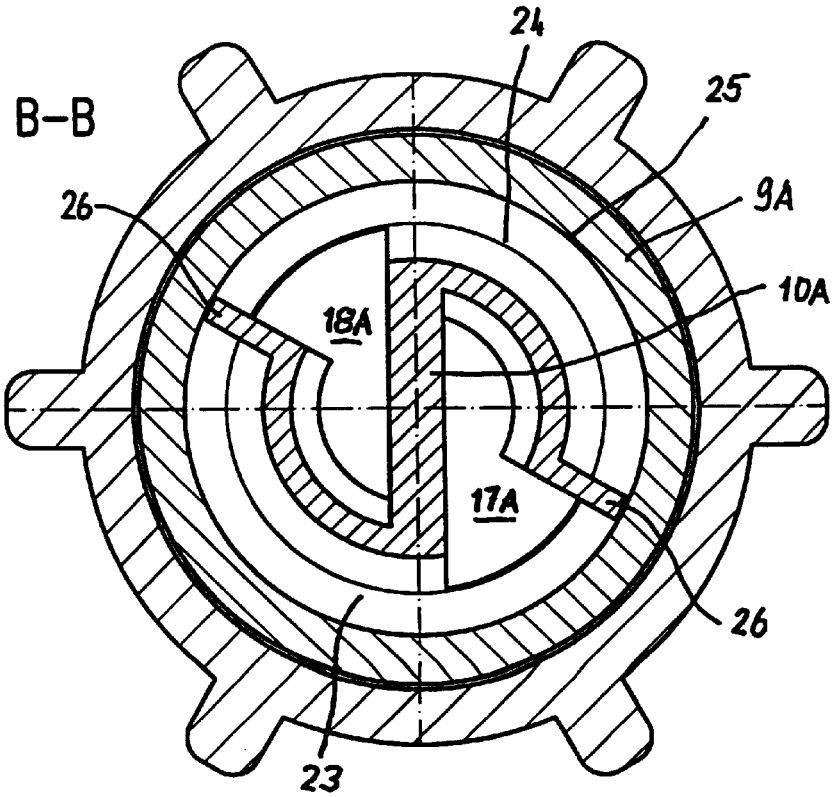
FIG. 9 is a cross-sectional view taken along the line B—B of FIG. 6.
Figure 10:
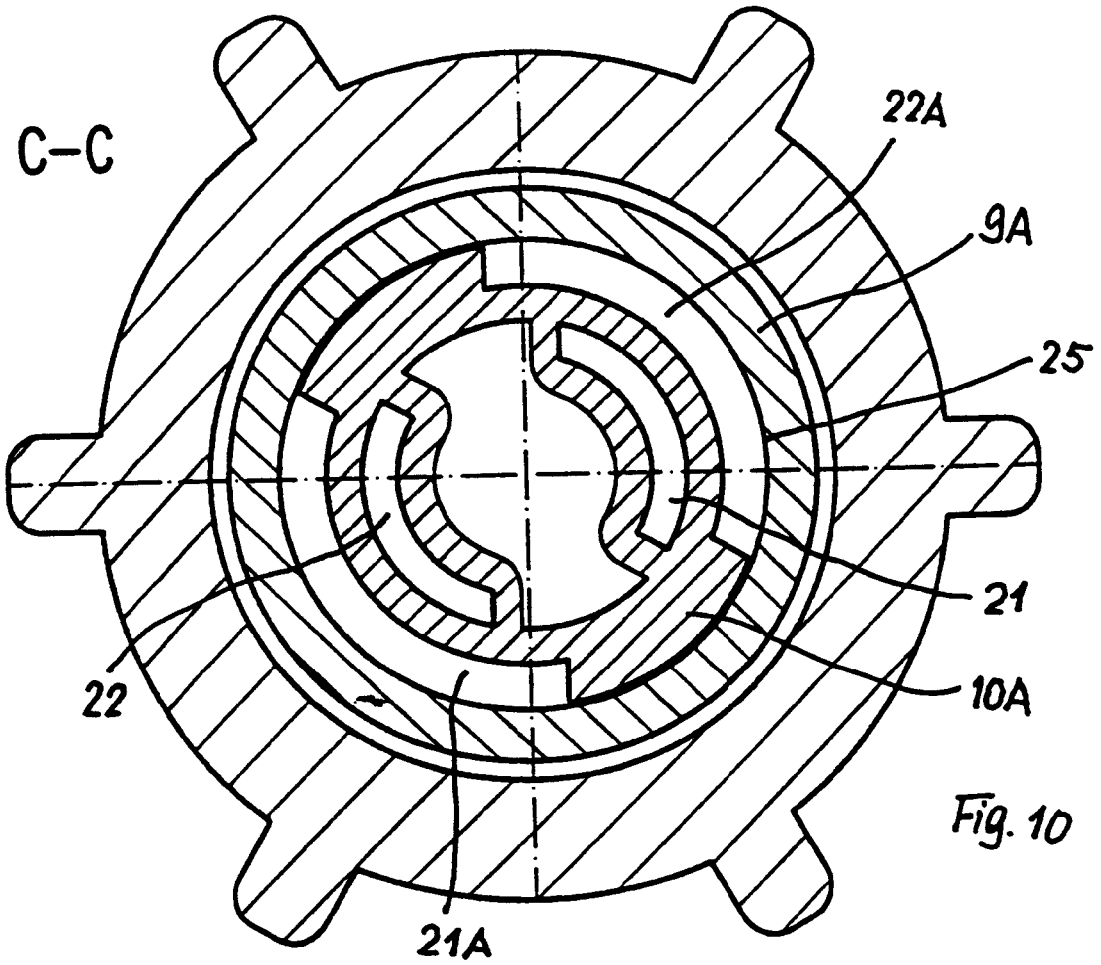
FIG. 10 is a cross-sectional view taken along the line C—C of FIG. 6.

Those parts, which correspond to the parts of the first exemplary embodiment, are identified by the same reference and the suffix letter A in the embodiment according to FIGS. 6 to 10. The separating wall 3A has again a groove 12A into which is received the lower end of the center web 13A. This center web 13A extends axially through the insert piece 10A. The passage opening 17A communicates with the outlet opening 7A, whereas the passage opening 18A communicates with the outlet opening 8A. The lower part of the mixing channel 9A telescopes over the insert piece 10A. The passage opening 18A has a first outlet 22 (FIG. 6). Similarly, the passage opening 17A has also a first outlet 21 (FIG. 10). The passage opening 17A includes a channel 23 extending in peripheral direction of the insert piece 10A, which channel 23 terminates in a second outlet 21A. The passage opening 18A has also a channel 24 extending in peripheral direction of the insert piece 10A, which channel 24 terminates in a second outlet 22A. The channels 23, 24 are separated by radially extending wall portions 26 (FIG. 9). The edges of the wall portions 26 rest on the inner wall of the lower part of the mixing channel 9A, it being noted that the lower part of the mixing channel 9A telescopes over the insert piece 10A. The channels 23, 24 are defined on the outside by the inner wall 25 of the lower part of the mixing channel 9A. The channel 23 terminates as aforesaid in the outlet 21A, whereas the channel 24 terminates as aforesaid at the outlet 22A.

The configuration of the outlets 21, 21A and 22, 22A resulting therefrom are shown in FIG. 10. The outlet 22A is radially outwardly offset with respect to the outlet 21A, whereas the outlet 21A is radially outwardly offset with respect to the outlet 22. The outlets 21, 21A communicate with the passage opening 17A, whereas the outlets 22, 22A communicate with the passage opening 18A. These outlets 21, 21A and 22, 22A are each designed as arcs or segments of a circle whereby the respective radially outwardly lying outlet 21A, 22A occupies a larger angular area than the adjacent outlets 21, 22. The channels 23, 24 and the associated outlets 21A and 22A are each defined by the inner wall 25 of the mixing channel 9A.

What is claimed is:

1. A two-component cartridge comprising a mixing channel releasably mounted on said cartridge, and an insert piece releasably mounted on said cartridge, whereby the cartridge has a first outlet opening and a second outlet opening and the insert piece has an upper end that is adjacent a mixing chamber of the mixing channel and a lower end that is adjacent the first and second outlet openings, wherein each of the first and second outlet openings are shaped as a half moon in a small tube, which small tube has a separating wall, the insert piece gripping over the small tube, the separating wall dividing the cartridge into a first chamber including a first component and a second chamber including a second component, such that said first outlet opening is adjacent said first chamber and said second outlet opening is adjacent said second chamber, and one of the separating wall and the insert piece includes a groove and an other of the separating wall and the insert piece includes a spring, said insert piece and said separating wall being connected by attachment of said spring and said groove, wherein said spring and said groove are configured to prevent relative rotating of the separating wall and the insert piece, and said insert piece has several passage openings including at least one passage opening having a first end that terminates in said upper end of said insert piece and a second end that terminates in said first outlet opening, at least one additional passage opening having a third end that terminates in said upper end of said insert piece and a fourth end that terminates in said second outlet opening, a first passage opening having a fifth end that terminates in said upper end of said insert piece and a sixth end that terminates in said second outlet opening and a second passage opening having a seventh end that terminates in said upper end of said insert piece and an eighth end that terminates in said first outlet opening, wherein said first end of said at least one passage opening is adjacent said fifth end of said first passage opening and said third end of said at least one additional passage opening is adjacent said seventh end of said second passage opening, whereby the orientation of the insert piece passage openings facilitates a pre-mixing of the first and second components when the first and second components flow from the first and second chambers into the mixing chamber.

2. The two-component cartridge according to claim 1, wherein the groove is arranged on the separating wall and the spring on the insert piece.

3. The two-component cartridge according to claim 1, wherein the insert piece has for each outlet opening several passage openings.

4. The two-component cartridge according to claim 1, wherein when the separating wall extends through the insert piece the outlets of the passage openings are arranged at a radial distance from one another, and the radially outwardly lying outlet and the associated passage opening consist of a channel extending in peripheral direction of the insert.

5. The two-component cartridge according to claim 2, wherein the spring is formed by a center web of the insert piece.

6. The two-component cartridge according to claim 3, wherein in a part of the passage openings the outlet is arranged radially offset with respect to the inlet.

7. The two-component cartridge according to claim 4, wherein each of the outlets are circular segments, and the radially outwardly lying outlet extends over a larger angular area than the radially inwardly lying outlet.

8. The two-component cartridge according to claim 4, wherein the channels and the radially outwardly lying outlets are defined by the inner wall of the lower end of the mixing channel.

9. The two-component cartridge according to claim 6, wherein, viewed in an axial projection, the outlet of a passage opening, the inlet of which communicates with the one outlet opening, extends offset in the area of the outlet of the other passage opening, the inlet of which passage opening communicates with the other outlet opening.

10. The two-component cartridge according to claim 6, wherein the offsetting is caused by a lip projecting into the respective passage opening and extending inclined with respect to the insert axis.

11. The two-component cartridge according to claim 10, wherein the lip edge defines the outlet.

* * * * *